US007757892B2

(12) United States Patent
Berman

(10) Patent No.: US 7,757,892 B2
(45) Date of Patent: Jul. 20, 2010

(54) CLOSURE DEVICE FOR CLOSED RECEPTACLES OF PLASTIC FILM

(75) Inventor: Ronald H. Berman, Long Beach, CA (US)

(73) Assignee: Bosch Pouch Systems AG, Neuhausen (CH)

( * ) Notice: Subject to any disclaimer, the term of this patent is extended or adjusted under 35 U.S.C. 154(b) by 678 days.

(21) Appl. No.: 11/268,883

(22) Filed: Dec. 27, 2005

(65) Prior Publication Data

US 2007/0062709 A1 Mar. 22, 2007

(30) Foreign Application Priority Data

Sep. 16, 2005 (CH) ..... 1514/05

(51) Int. Cl.
*B67D 1/00* (2006.01)
*B67D 3/00* (2006.01)

(52) U.S. Cl. ..... 222/91; 222/83

(58) Field of Classification Search ..... 222/80–91, 222/520–525

See application file for complete search history.

(56) References Cited

U.S. PATENT DOCUMENTS 4,690,304 A * 9/1987 Morel ..... 222/44
5,004,127 A * 4/1991 Morel ..... 222/521
5,020,690 A 6/1991 Kishikawa et al.
5,141,133 A 8/1992 Ninomiya et al.
5,147,070 A * 9/1992 Iwamoto ..... 222/83
5,297,696 A 3/1994 Bernstein et al.
5,366,114 A * 11/1994 Bernstein et al. ..... 222/83
5,425,583 A 6/1995 Wild
5,482,176 A 1/1996 Maietta et al.
5,960,992 A 10/1999 Bernstein et al.
6,279,779 B1 8/2001 Laciacera et al.
6,398,075 B1 * 6/2002 Laciacera et al. ..... 222/91
6,422,412 B1 * 7/2002 Sagawa ..... 220/277
2002/0179605 A1 * 12/2002 Miani et al. ..... 220/277
2004/0057637 A1 3/2004 Nishibe et al.

FOREIGN PATENT DOCUMENTS

EP 1415926 A1 5/2004
JP 11171233 6/1999
WO WO 03/002419 A1 1/2003

* cited by examiner

*Primary Examiner*—Kevin P Shaver
*Assistant Examiner*—Stephanie E Tyler
(74) *Attorney, Agent, or Firm*—Fulwider Patton LLP

(57) ABSTRACT

A closure device attachable above a location of a closed receptacle, comprising a stopper portion with a cylindrical pour-out spout connected or connectable to the receptacle, and a screw cap screwed onto the lower part, and a cylindrical piercing element that in the axial direction is open at both sides and is displaceably mounted in the lower part, wherein catch portions move the piercing element helically downwards when screwing off the cap for the first time, wherein the piercing element is equipped with at least one cutting element.

14 Claims, 4 Drawing Sheets

CLOSURE DEVICE FOR CLOSED RECEPTACLES OF PLASTIC FILM

FIELD OF THE INVENTION

The present invention is related to closure devices for drink containers such as pouches and the like.

BACKGROUND OF THE INVENTION

Closure devices for drink pouches and containers are known in various embodiments from various documents, and are known to be obtainable on the market. On the part of the applicant, U.S. Pat. No. 5,020,690 is seen as being one of the earliest documents describing such a closure device. This reference describes a closure device where the catch means in the screw cap serves to encourage a movement of the piercing means running in the axial direction. The piercing means does not rotate, but rather employs only an axial, translatory motion according to the action of the catch means. The rotation required for achieving a screw motion is prevented by cams on the piercing means that are arranged on suitable guides in the pour-out spout.

The cutting element with the mentioned embodiment according to the '690 patent is formed of a multitude of teeth. A solution which is known from U.S. Pat. No. 5,141,133 is comparable. Here, the cutting element consists of a continuous peripheral gapless series of teeth which border one another, so that the piercing means practically has the shape of an annular saw tooth. This solution otherwise has the same drive system as the previously described embodiment according to '690 patent.

In all previously mentioned references the piercing means as a result have a purely axial translatory movement without any rotation. This means that the piercing means is literally pushed through the packaging material of which the receptacle consists. For this, one needs to know that all closure devices which correspond to the initial mentioned construction type, up to this date, have been attached onto receptacles which are manufactured of a multi-layered material and essentially consists of paper and/or cardboard with additional extraordinarily thin layers of plastic and/or aluminum. The cutting elements which consists of a multitude of teeth as already mentioned, could only carry out a perforation with their tips. In order for corresponding closures to be capable of functioning at all, the receptacles needed to have a part-punching (part-perforation) or part embossing by way of which the packaging material was already greatly weakened. Such a pre-punching means that the cylindrical pour-out spout of the lower part's opening needed to be attached over this pre-punching in an as congruent as possible manner. This is extremely difficult with regard to technology, in particular since the attachment of the lower part's opening may not be placed in an exact manner with a mechanical connection, but rather the opening of the lower part needs to be bonded onto the packaging, and with the manufacturing speeds required today, a deviation is always present in practice. Accordingly, the dimensions were designed such that a certain tolerance is permitted. Thus, the pre-punching is dimensioned somewhat smaller that the free diameter of the cylindrical pour-out spout. The rejection rate with closures of this construction type were extremely high despite these precautionary measures. These rejects were not only caused by the fact that the hardly realizable accuracy could not be kept, but also because of the problem of a suitable adhesive dosing/metering in order to bond the lower part opening onto the film. Even slight excesses of adhesive lead to the adhesive also partly being squeezed towards the center when pressing-on, and thus this adhesive reaches precisely the region of the pre-punching. As soon as the adhesive is cured, one may no longer realize a correct and perfect severing of the packaging material by way of the piercing means. Logically, a problem also results when using too little adhesive, since then the bonding of the lower part's opening on the film-like packaging material is inadequate and when rotating on, the piercing means has practically only pushed off the foil of the packaging material from the flange of the pour-out spout.

After this problem was recognized, closure devices of the initially mentioned type have been realized, with which the piercing means was no longer advanced in a purely translatory movement, but as initially mentioned, the piercing means was then moved downwards while twisted in a helical manner. For this, suitable catch means were provided in the screw cap, which cooperate with correspondingly cooperating catch means in the piercing means. Solutions of this type are known for example from U.S. Pat. Nos. 5,297,696, 5,482,176 and 5,960,992. However all these devices continue to demand a pre-punching of the film material of which the receptacle consists, and furthermore with these solutions, the cutting means is always realized by a continuous crown of teeth. Thanks to the screw movement which was then effected, these teeth in practice executed a sawing activity. Added to this is the fact that a certain eccentric attachment of the closure device relative to the pre-punching was less pragmatic, since the teeth crown, given the eccentricity, crosses the pre-punching at least once, usually twice, and thus at least one tooth may penetrate there and thus perform the perforation of the plastic film layer. Since the plastic is embedded, this may no longer expand more than specifically in the narrow slot-like region of the pre-punching which is only a few hundredths of a millimeter. The teeth thus on the one hand could sever the paper/cardboard layers in the manner of a saw and thus perforate the plastic film as soon as the teeth engaged the plastic film. With this, the multitude of teeth was seen as an advantage, since a multitude of perforations arise due to this.

However it has been ascertained that a plurality of perforations per se results in no advantage. Rather, it has been shown that a multitude of teeth automatically leads to the fact that these teeth need to be relatively weak. Whilst this is of hardly any relevance with regard to the perforation as long as the teeth are sharp, it has however been shown that the severing of the essentially thicker main layers of paper and cardboard in a saw-like manner leads to the fact that these teeth become blunter on the one hand, and get surrounded by fibers on the other hand, and the result of this is a lower perforating ability.

Accordingly, further developments have proceeded from this recognition, with which on the one hand the number of teeth were reduced and on the other hand the shape of the teeth were designed differently. Thus for example a solution with a number of equally high teeth which are distributed over the periphery in a non-uniform manner is known from European Patent Application No. 1,415,926. Finally, according to U.S. Pat. No. 6,279,779, a closure device with a piercing means is disclosed which only has a single tooth. This tooth is designed in a suitably strong manner and has different surfaces with a different effect. Thus the tooth has a sharp-edged, angular region which serves for perforation, as well as a cutting region. Thanks to its suitable thickness, it simultaneously also has a repelling function, where this repelling function is realized by a separate displacer that is likewise arranged on the piercing means. The one-tooth version has definitely not proven its worth. The procedures of severing the cardboard, the perforation of the plastic film component and cutting the complete material and finally folding away the cut-out part have not been able to be optimized with a single element.

The documents which have been described in detail earlier, which show closure devices with a cylindrical piercing means with which the complete lower piercing means edge is provided with a multitude of equally high teeth led to the fact that practically all teeth simultaneously reached the film to be pierced. With this however, the force necessary for severing the plastic films was increased enormously. The elasticity of the film for this reason did not lead to the desired effect, that with the impinging of the teeth, the perforation is severed practically equally to the contact of a soap bubble. In order to avoid this negative effect, Japanese Patent Application No 11-171233 suggests a solution with a plurality of teeth which are all arranged at different heights. The force for severing the film is reduced by way of this.

As already mentioned initially, all previously known closure devices of the initially mentioned type which may be obtained on the market, with regard to their design have been conceived for a packaging material which as mentioned, consists of mixtures of the most different of materials, and in particular contains a high constituent of paper and cardboard. Such packaging material has a corresponding strength which is desired in certain cases, but with regard to those cases in which in particular the waste volume is to be reduced, as well as other properties which are not being discussed in detail here, are to be achieved, packaging material that consists essentially of only one plastic film and merely has one or more additional blocking layers of other materials is suitable, wherein these blocking layers have a thickness in the region of several μ. All previously known closure devices are completely unsuitable for such materials.

SUMMARY OF THE INVENTION

It is therefore the object of the present invention to create a closure device of the initially mentioned type, which whilst avoiding the previously known problems, is especially suitable for soft packaging which practically consists of a single plastic film with or without blocking layers. A closure device is characterized in that three cutting elements are arranged distributed over the periphery of the lower edge, wherein the cutting elements are teeth and the distance of the tips of the first tooth to the second tooth on the periphery has a magnitude X, at the distance of the tip of the second tooth to the third tooth has the magnitude Y, whilst the distance of the tips of the third tooth to the first tooth is Z, and that a stiffening shoulder running in the peripheral direction is allocated to each of them, wherein the stiffening shoulder is arranged on two teeth following the tooth in the cutting rotation direction, and on a third tooth running ahead of this tooth in the cutting direction, wherein each shoulder with the associated tooth are designed merging into one another, and that furthermore the tips of all three teeth are arranged at the same height distanced to the lower edge and that the closed receptacle to be opened is manufactured of a single-layer or multi-layer plastic film. Other features and advantages of the invention will become apparent from the following detailed description, taken in conjunction with the accompanying drawings which illustrate, by way of example, the features of the invention.

DETAILED DESCRIPTION OF THE INVENTION

A single preferred embodiment model is represented in the accompanying drawings, wherein here, the screw cap that results in no new aspects with regard to the invention has been omitted. The publication WO 03/002419 is expressly referred to with regard to the design of the screw cap, which has a cover surface on whose lower side an annular wall is integrally formed which in turn on its lower side, that directed toward the center, comprises catch elements which cooperate with corresponding pawl-like catch elements on the piercing means. Thus for the present invention which relates essentially to the particular design of the piercing means, it is assumed that this piercing means is equipped with a screw cap which with at least respect to its functional parts, corresponds to the design according to the screw cap in WO 03/002419.

Figure 1:
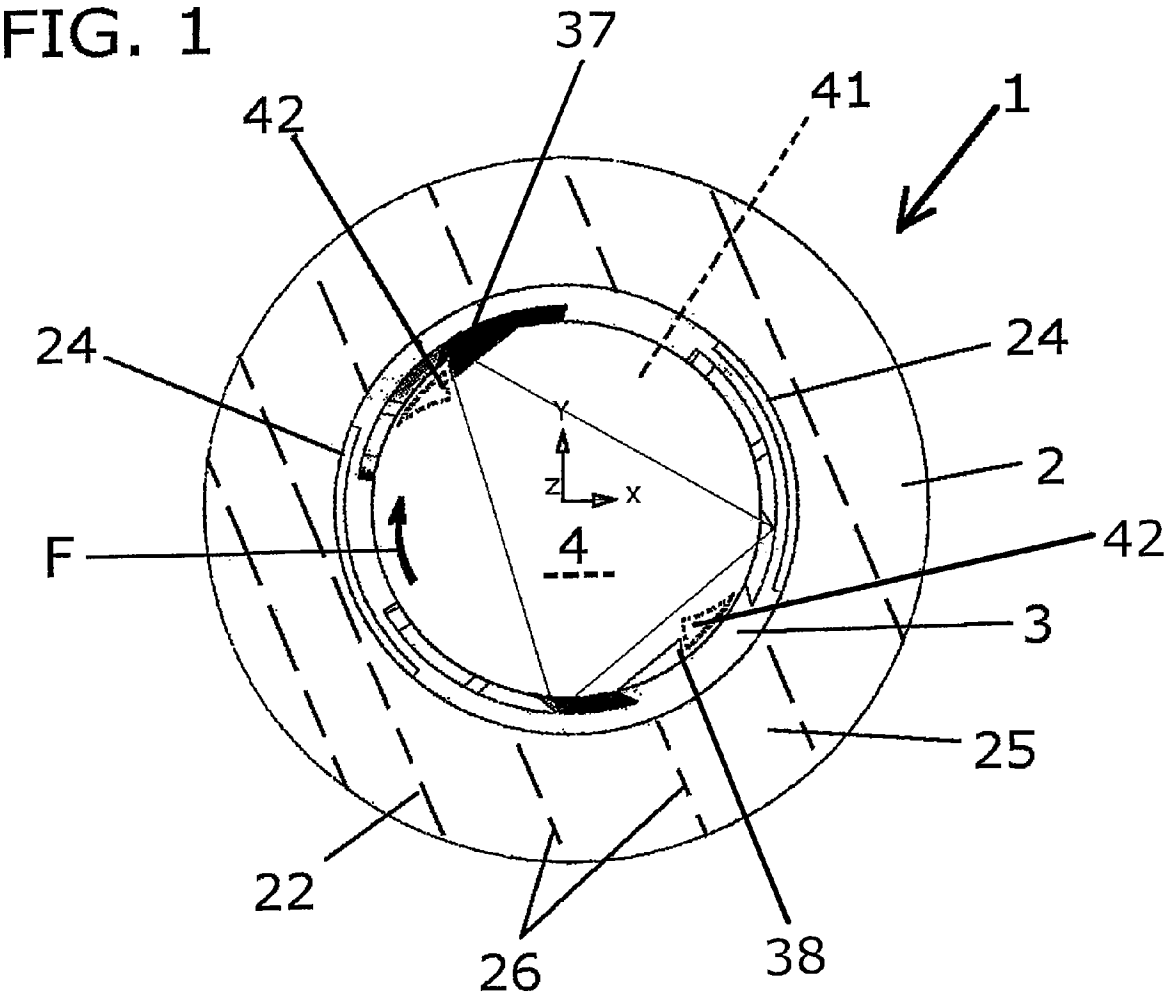
FIG. 1 is a plan view of the closure part from below with the piercing means fully screwed into the lower part's opening.
Figure 3:
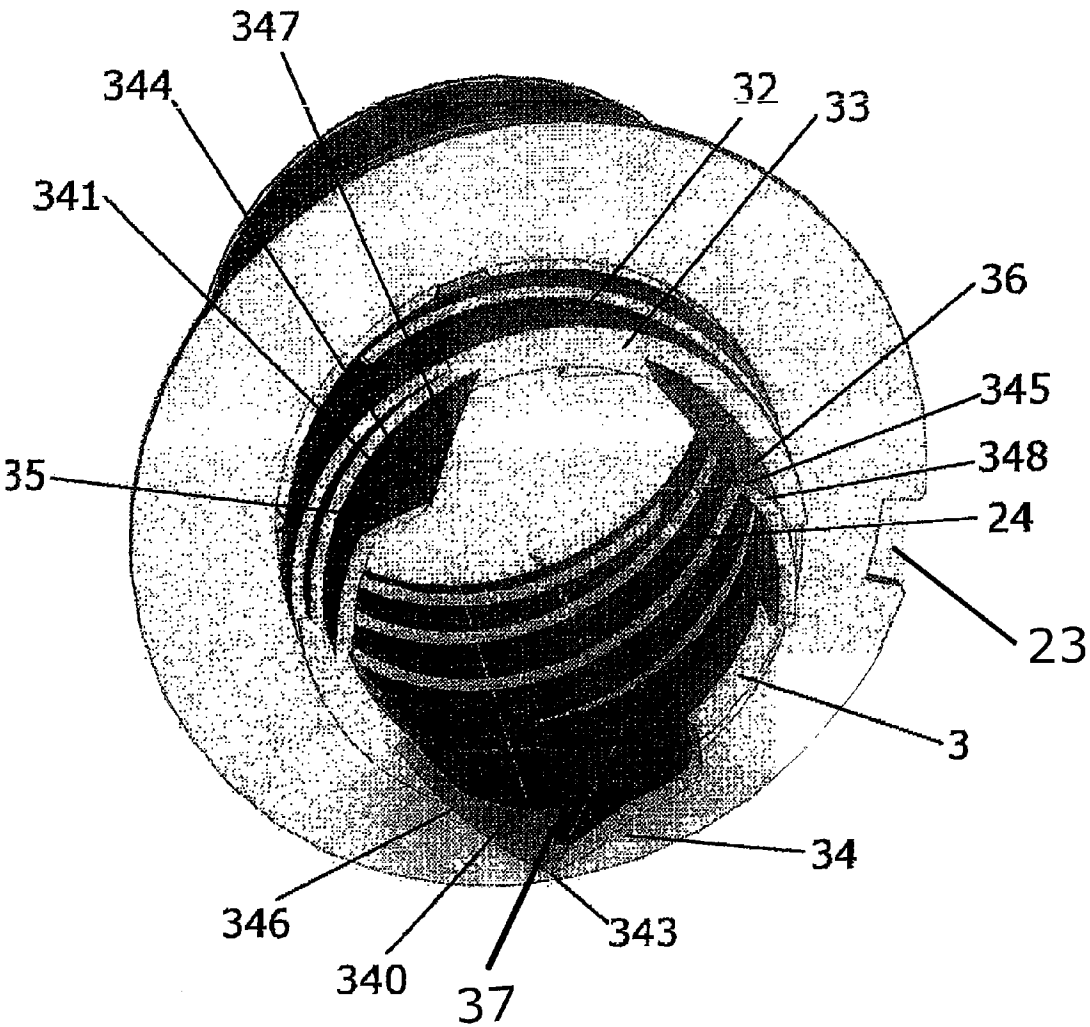
FIG. 3 is the closure device of FIG. 2 with the piercing means completely screwed-off up to the position of use.

Apart from the screw cap which as already mentioned is not represented here, the closure device which in its entirety is indicated at 1, additionally comprises two further parts, specifically an annulus 2 and a cylindrical piercing means 3 which is mounted therein in the manner of a screw connection. The closure device 1 according to the invention, thus in the position of use, consists of three separate elements, wherein the screw cap, although only hinted, is present in FIG. 1 with the reference numeral 4. In FIG. 1, the assembled closure device 1 may be recognize from below with a view onto the annulus 2, wherein the cylindrical piercing means 3 is shown in the fully screwed-in position. The screw cap would be recognizable here with a view of the inner side of the cover surface 41, and its catch elements which are radially inwardly resilient stays, are indicated at 42. These catch elements 42 are designed such that they catch the piercing means 3 on screwing on the screw cap 4, wherein the piercing means 3 is set into a screw movement with which the piercing means 3 is moved out of the annulus 2 in the direction of the receptacle, and the piercing means 3 thus severs the film of the packaging. The screwing-on direction is indicated with the arrow F. The screw cap 4 is closed on rotating in the opposite direction. On opening for the first time, with which the screw cap 4 is rotated in the direction F, the piercing means 3 is moved into an end position as is represented in FIG. 3. In that position, the catches 42 of the screw cap 4 are no longer actively connected to the piercing means 3, so that the piercing means 3 remains in the end position when afterwards the screw cap 4 is rotated back in the direction opposite to the arrow F. After actuation of the closure device 1 for the first time, this functions as a common screw closure on a annular pour-out.

Figure 2:
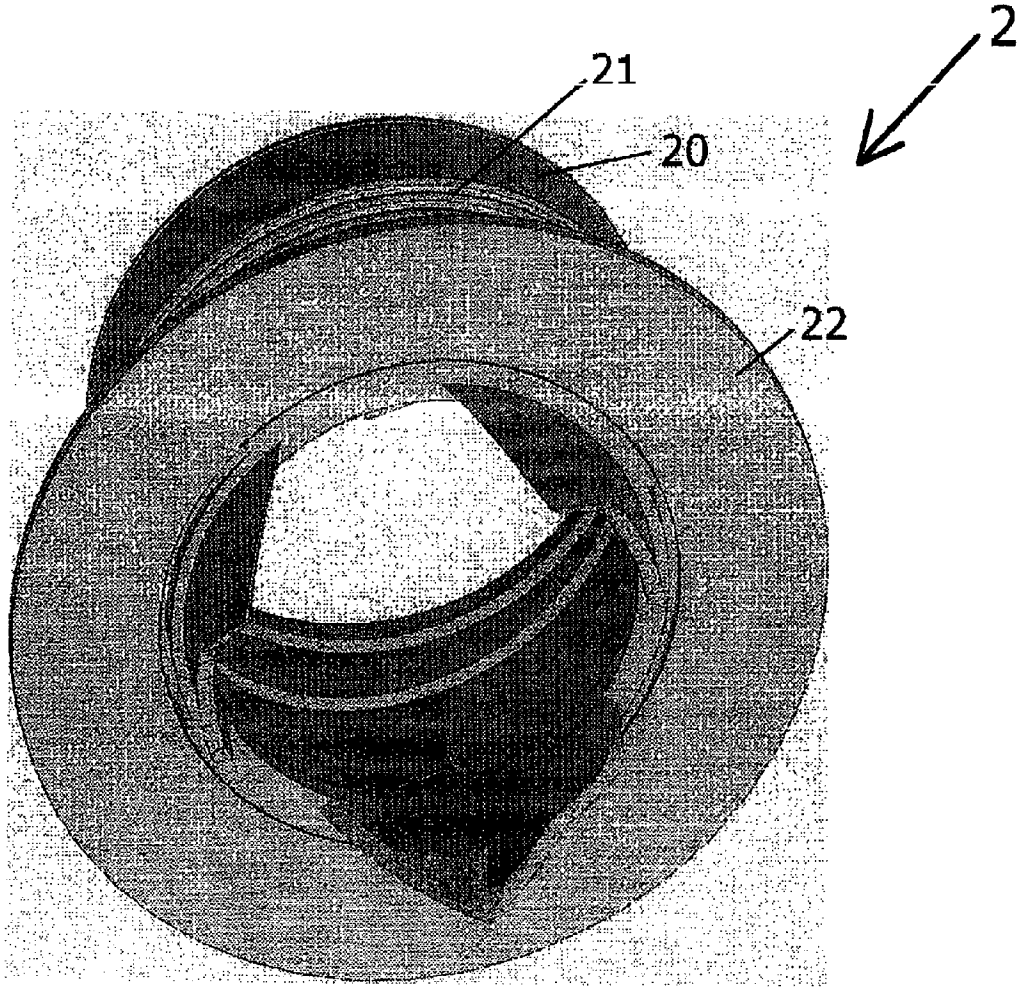
FIG. 2 is a three-dimensional plan view of the closure device whilst omitting the screw cap, with the piercing means partly screwed-off.

FIGS. 1 and 2 are particularly referred to with regard to the subsequent explanations which relate to the annulus 2. The annulus 2 comprises two main components which are manufactured integrally with one another as one piece, specifically a cylindrical tube section 20 which forms the pour-out spout, and a connection flange 22 arranged at the end of this. The connection flange 22 serves for a bonding or welding connection of the closure device 1. to the packaging, which is not shown here and which consists of a single-layer or multi-layer plastic film as has already been mentioned. In the case that the annulus 2 is to be connected to the packaging by way of welding, the lower side 25 may be provided with energy conducting ribs 26 which here are only indicated in FIG. 1. Furthermore the connection flange 22 at the end may be provided with an optional orientation notch 23 which is only drawn in the FIGS. 1 and 3. The optional orientation notch 23 serves merely as an orientation aid in an assembly device. Thus a positioning which may be brought radially into a certain angular position is possible thanks to the orientation notch 23. This may be advantageous depending on the design of the assembly device, but in now way is it compelling.

The cylindrical tube section 20 or the pour-out spout comprises an outer thread 21 which is arranged on its cylindrical outer surface and which serves for connection to the screw cap 4. This outer thread is preferably formed as a fine thread so that the screw cap may be pressed on directly during assembly without any screw movement, wherein the inner thread of the screw caps which cannot be seen here, with the outer thread 21 on the pour-out spout may be pushed over one another in a pawl-like manner. The cylindrical tube section 20 furthermore has an inner thread 24 which is only suggestively recognizable in FIG. 1 and is designed as two-path inner thread. Here with regard to the invention it is not important as to whether this inner thread 24 is designed of single flight or multiple flights.

Figure 4:
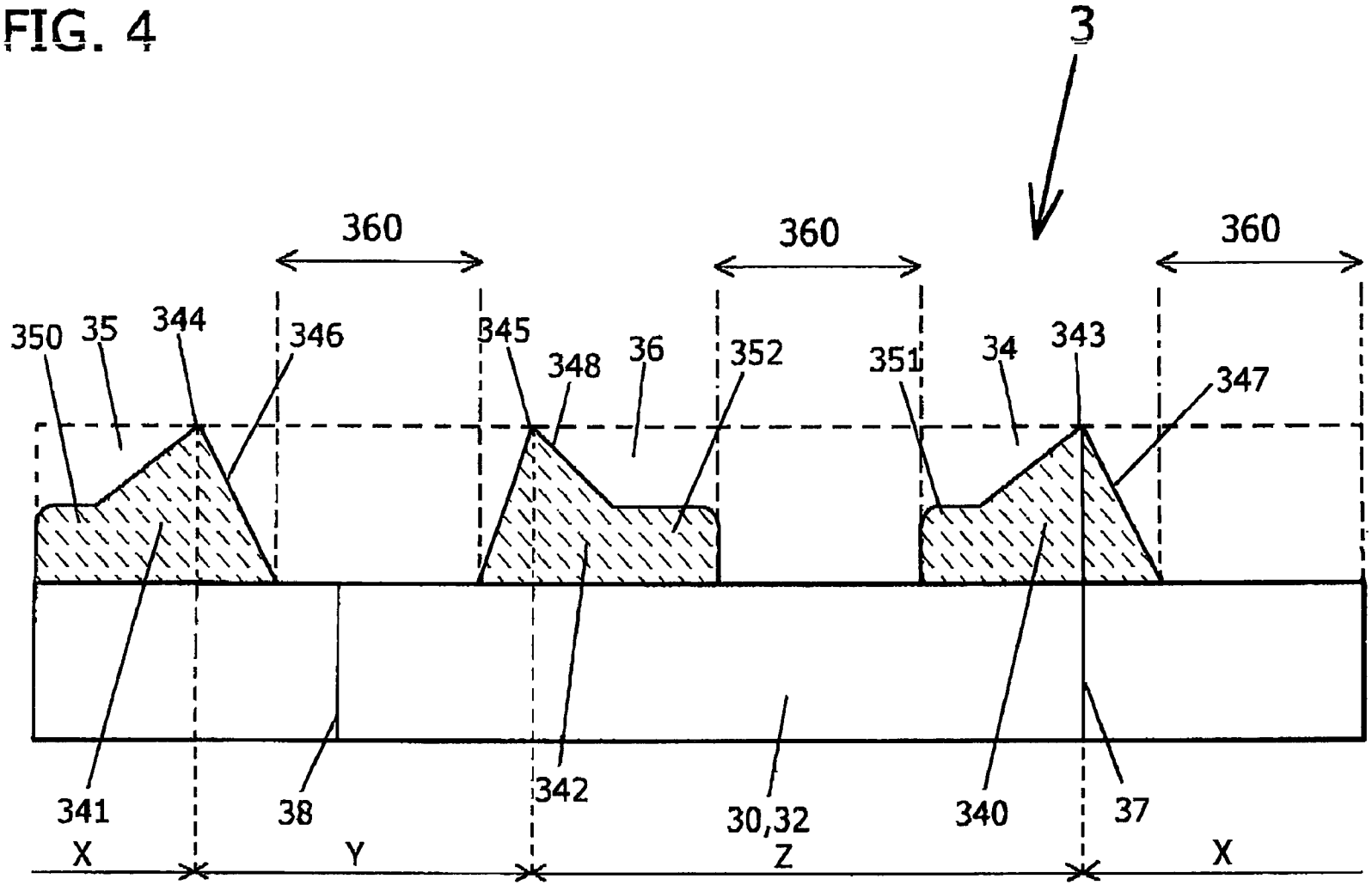
FIG. 4 is a schematic view of the piercing means in its "unwound" state, for clarifying the arrangement of the three cutting elements according to the invention.

The elements which are particularly important with regard to the invention may be recognized on the piercing means 3, and FIGS. 3 and 4 are particularly referred to with regard to their description and explanation. The cylindrical piercing means 3 comprises a cylindrical tube section 30 which here is completely open on both sides. The cylindrical tube section 30 has an outer thread 31 which cooperates with the inner thread 24 in the cylindrical tube section 20, the pour-out spout. The piercing means 3 is drawn in its lowermost position in FIG. 3, so that the inner thread 24 is evident in the pour-out spout 20. The piercing means 3 has an annular peripheral wall (skirt) 32 whose lower end-face 33 forms a base surface for the three cutting elements 34, 35, 36 which are integrally formed thereon as one piece. The cutting elements 34, 35, 36 are thus formed as one piece with the peripheral wall 32 of the cylindrical tube section 30 via the end-face 33. The three cutting elements in each case comprise one tooth.

The cutting element 34 has one tooth 340, the cutting element 35 a tooth 341, and the third cutting element 36 a tooth 342. In FIG. 3 the screwing-on direction is represented by the arrow F. Each tooth 340-342 has a tip. With this, the tips 343 of the tooth 340 as well as the tip 344 of the tooth 341 are designed as perforating tips, whilst the tip 345 of the tooth 342 serves as a perforating tip, or as shown here, also as a pressing tip 345. All tips 343-345 lie in a plane and thus situated distanced equally far from the lower end-face 33 of the peripheral wall 32. With this, with a screwing-on movement, i.e. in the direction of arrow F in which the closure is opened or the screw cap 4 is removed and the cylindrical piercing means 3 moves in the direction of the receptacle, it is ensured that the tips simultaneously come to lie onto the film of the package. With this thus a tensioning of the film to be severed is effected in a first step. Only when this tension is built up is a perforation of the film then effected, as least with the two perforation tips 343 and 344. Each tooth 340-342 comprises a suitable cutting edge 346-348. The cutting edges 346-348 are arranged such that they become effective on rotation in the direction of the arrow F. Whilst the cutting edge 346 of the tooth 340 as well as the cutting edge 347 of the tooth 341 run from the corresponding tip 343 and 344 respectively to the lower end-face 33 of the cylindrical tube section 30, the cutting edge 384 is shortened as a cutting edge runs from its tip 345 only up to a stiffening shoulder yet to be described. A stiffening shoulder 350-352 is allocated to each tooth 340-342. The two stiffening shoulder 350 and 351 are arranged following the correspondingly allocated teeth 340 and 341 in the cutting direction, whilst the stiffening shoulder 352 is arranged running ahead of the corresponding tooth 342 in the running direction. In particular the stiffening shoulder 352 running ahead is also extended. The stiffening shoulders 350-352 serves for reinforcing the teeth 340-342 such that they do not fold over on building up the tension. Since it is particularly the tooth 342 which, as will yet be described hereinafter, has a further function, which is to accommodate increased forces, the corresponding stiffening shoulder 352 is designed longer.

As is evident from the unrolled view according to FIG. 4, the distance between the first tooth 340 and the second tooth 341 is the distance X, whilst the distance between the second tooth 341 and the third tooth 342 has the distance Y, and finally the distance between the third tooth 342 and the first tooth 340 forms the distance Z. Here it is evident that the distances X and Y are shorter than the distance Z. With this, it is to be ensured that in particular the cutting elements 34 and 35 execute the main cutting activity, whilst the cutting element 36 exerts a cutting and displacement activity. In principle it is possible to design the distances X and Y equally large. This however is not absolutely necessary, but only represents a question of optimization which essentially depends on the material selection.

The piercing means 3 on its inner surface situated towards the center comprises two catch edges 37 and 38 which cooperate with the catch elements 42. More preferably one would situate one of the two catch edges 37 such that this is flush with the tip 343 of one of the cutting elements 34. These catch edges form a thickening in the radial direction and accordingly stiffen the tooth, so that this is stiffened with respect to a deformation. The second catch edge 38 lies in the piercing means 3 roughly diametrically opposite the first catch edge 37.

Gaps 360 remain in each case between two adjacent cutting elements 34-36. These gaps are preferably all equally large. This simplifies the engagement of suitable fingers of an assembly machine, but has no influence on the actual severing function of the piercing means. The gradients of the cutting edges 346-348 may also be differently large. In the embodiment shown here, the cutting edges 346 and 347 are designed equally in gradient, whilst the shortened cutting edge 348 of the cutting element 36 takes a flatter course. Thus in each case one cutting edge 346-348 runs from each tip 343-345, whilst the edges distant to the cutting edge are indicated as following edges. The angle which the respective cutting edge and the associated following edge enclose with one another at the respective tip is indicated at $\alpha$. This angle is preferably less than 150°. In the preferred embodiment, in particular with the tips 343 and 344, as are shown here, the angle $\alpha$ is 90°. This again is in no way absolutely compelling but merely a preferred magnitude which was determined by experiment.

As already mentioned, the lower side 25 of the flange 22 may be provided with energy conducting ribs 26. These energy-conducting ribs 26 which are one embodiment of energy conducting means may of course be designed in different manners. Here too, experiments have shown that two embodiments are particularly suitable, specifically one with which these energy conducting means are also formed from ribs projecting perpendicularly from the flange, which either are arranged running radially from the inside to the outside in a flush manner or concentrically. These two versions may also be combined with one another. With the concentrically arranged energy conducting ribs, one would arrange at least the innermost energy rib approximately flush with the inner edge of the pour-out opening of the bung-like lower part.

I claim:

1. A plastic closure device for use with a pouch receptacle comprising:

an annulus with a cylindrical pour-out spout connectable to the receptacle;

a screw cap screwed onto the annulus;

a cylindrical piercing means open in the axial direction at both sides and displaceably mounted at said annulus, wherein catch means are present in the screw cap, said catch means moving the piercing means helically downwards when screwing off the screw cap for the first time, and wherein the piercing means is equipped with at least one cutting element, characterized in that three cutting elements are arranged distributed over a periphery of a lower edge, wherein the cutting elements are teeth and the distance of the tips of a first tooth to a second tooth on the periphery has a magnitude X, and a distance of the tip of the second tooth to the third tooth has the magnitude Y, whilst a distance of the tips of the third tooth to the first tooth is Z, and that a stiffening shoulder running in the peripheral direction is allocated to each tooth, wherein the stiffening shoulder is arranged on two teeth following the tooth in a rotational cutting direction on a lower edge of a peripheral wall of the cylindrical piercing means, and on a third tooth running ahead of this tooth in the cutting direction on a lower edge of a peripheral wall of the cylindrical piercing means, wherein the tips of all three teeth are arranged at the same height distanced to the lower edge and a cutting edge on a first and second teeth runs from a tip to the lower edge and a cutting edge on a third tooth runs from a tip to an associated stiffening shoulder, and that the receptacle to be opened is manufactured of a single-layer or multi-layer plastic film wherein the height of the stiffening shoulder corresponds to at least a third of a height of the tooth from the lower edge of the cylindrical piercing means up to the tip of the tooth, and maximally two thirds of this height.

2. A closure device according to claim 1, wherein distances X and Y are equal.

3. A closure device according to claim 1, wherein a gap equal to one tooth length is present between two adjacent teeth.

4. A closure device according to claim 3, wherein the width of all three gaps is equally large.

5. A closure device according to claim 1, wherein each tooth has a cutting edge and a trailing edge, wherein the two edges enclose an angle $\alpha$ of less than 150°.

6. A closure device according to claim 5, wherein the angle $\alpha$ is maximally 90°, wherein the angle $\alpha$ at one tooth is smaller that with the two remaining ones.

7. A closure device according to claim 1, at least one catch flank is present in the cylindrical piercing means, said flank cooperating with a catch means on the screw cap, wherein the catch flank has a ramp-like shape and with its height alignment runs directed radially to the piercing means axis, whilst the ramp edge runs parallel to a piercing means axis.

8. A closure device according to claim 7, wherein a ramp edge is situated such that it runs through the tip of a tooth.

9. A closure device according to claim 1, wherein the cylindrical piercing means is manufactured as one piece with the cylindrical pour-out spout, and both parts are arranged axially aligned above one another, wherein the teeth of the piercing means are arranged in a region of the upper edge of the pour-out spout and here breaking point bridges form a frangible connection between the pour-out spout and the piercing means.

10. A closure device according to claim 9, wherein the tips of the teeth lie axially as well as radially within the region of the cylindrical pour-out spout.

11. A closure device according to claim 9, wherein the annulus comprises a flange which on its surface is directed towards the receptacle is provided with energy conducting means.

12. A closure device according to claim 11, wherein the energy conducting means are ribs which project perpendicularly from the flange and which with respect to the center are arranged running in a radially aligned manner.

13. A closure device according to claim 11, wherein the energy conducting means are ribs projecting perpendicularly from the flange, wherein at least one rib at least approximately is aligned with the inner edge of the pour-out opening of the annulus.

14. A plastic closure device for use with a pouch receptacle comprising:

an annulus with a cylindrical pour-out spout connectable to the receptacle;

a screw cap screwed onto the annulus;

a cylindrical piercing means open in the axial direction at both sides and displaceably mounted at the annulus, wherein a catch means is present in the screw cap, the catch means moving the piercing means helically downwards when screwing off the screw cap for the first time;

wherein the piercing means is equipped with three cutting elements distributed over a periphery of a lower edge, wherein the cutting elements are teeth and the distance of the tips of a first tooth to a second tooth on the periphery has a magnitude X, and a distance of the tip of the second tooth to the third tooth has the magnitude Y, whilst a distance of the tips of the third tooth to the first tooth is Z, and a stiffening shoulder running in the peripheral direction is allocated to each tooth;

wherein the stiffening shoulder is arranged on two teeth following the tooth in a rotational cutting direction on a lower edge of a peripheral wall of the cylindrical piercing means, and on a third tooth running ahead of said tooth in the cutting direction on a lower edge of a peripheral wall of the cylindrical piercing means;

wherein the tips of all three teeth are arranged at the same height distanced to the lower edge and a cutting edge on first and second teeth runs from a tip to the lower edge and a cutting edge on a third tooth runs from a tip to an associated stiffening shoulder, each tooth and its associated stiffening shoulder forming said cutting elements which are standing on the lower edge of the cylindrical piercing means while each tooth is standing on the stiffening shoulder wherein the distances X and Z are equal; and wherein a gap equal to one tooth length is present between two adjacent teeth; and wherein the width of all three gaps is equal; and wherein each tooth has a cutting edge and a trailing edge and wherein at least one catch flank is present in the cylindrical piercing means, the flank cooperating with a catch means on the screw cap, wherein the catch flank has a ramp and with its height alignment runs directed radially to the piercing means axis, whilst the ramp edge runs parallel to a piercing means axis; and wherein a ramp edge is situated such that it runs through the tip of a tooth.

* * * * *